US011638474B2

(12) United States Patent
Noble

(10) Patent No.: US 11,638,474 B2
(45) **Date of Patent: *May 2, 2023**

(54) AUXILIARY STRAP ASSEMBLY

(71) Applicant: 5.11, Inc., Manteca, CA (US)

(72) Inventor: Matthew Noble, Manteca, CA (US)

(73) Assignee: 5.11, Inc., Manteca, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/543,573

(22) Filed: Dec. 6, 2021

(65) Prior Publication Data

US 2022/0160115 A1 May 26, 2022

Related U.S. Application Data

(63) Continuation of application No. 16/688,917, filed on Nov. 19, 2019, now Pat. No. 11,191,345.

(60) Provisional application No. 62/769,885, filed on Nov. 20, 2018.

(51) Int. Cl.
*A45F 3/14* (2006.01)

(52) U.S. Cl.
CPC ..... *A45F 3/14* (2013.01); *A45F 2003/142* (2013.01)

(58) Field of Classification Search
CPC ... A45F 3/14; A45F 2003/142; Y10T 24/4093
See application file for complete search history.

(56) References Cited

U.S. PATENT DOCUMENTS

| | | | | |
|---|---|---|---|---|
| 1,216,881 | A * | 2/1917 | Tabler | A44B 11/04 24/200 |
| 1,264,996 | A * | 5/1918 | Tabler | A44B 11/04 24/200 |
| 2,269,696 | A | 1/1942 | Shaulson | |
| 3,969,792 | A * | 7/1976 | Hattori | A44B 11/02 24/200 |
| 4,400,855 | A * | 8/1983 | Stuart | B65D 63/16 24/200 |
| 5,084,946 | A | 2/1992 | Lee | |
| D363,257 | S | 10/1995 | Anscher | |
| D365,044 | S | 12/1995 | Anscher | |
| 5,765,888 | A | 6/1998 | Stack | |
| 6,152,338 | A | 11/2000 | Smith | |
| 6,152,342 | A | 11/2000 | Suk | |
| 6,530,129 | B1 | 3/2003 | Cheng | |
| D508,661 | S | 8/2005 | Kaneko et al. | |
| D542,710 | S | 5/2007 | Yoshiguchi | |

(Continued)

OTHER PUBLICATIONS http://www.itwnexusadvanced.com/content/web-dominator (Continued)

*Primary Examiner* — Robert Sandy
*Assistant Examiner* — Louis A Mercado
(74) *Attorney, Agent, or Firm* — Knobbe Martens Olson & Bear LLP

(57) ABSTRACT

An auxiliary strap assembly provides a simple, adjustable strap device for mounting objects to an underlying load bearing platform. In some implementations, the strap assembly includes an elongate anchor body that provides support to the object(s) being secured and/or to the underlying load bearing platform. The strap assembly can be adapted for connection to ladder webbing, such as Pouch Attachment Ladder System (PALS) or HEXGRID® mounting system.

18 Claims, 21 Drawing Sheets

(56) References Cited

U.S. PATENT DOCUMENTS

| | | | | |
|---|---|---|---|---|
| D562,728 | S | 2/2008 | Downing et al. | |
| D576,075 | S | 9/2008 | Freeman | |
| D591,200 | S | 4/2009 | Freeman | |
| D633,415 | S | 3/2011 | Grimm et al. | |
| D687,509 | S | 8/2013 | Iannello et al. | |
| 8,713,764 | B1 | 5/2014 | Rittenhouse et al. | |
| D709,797 | S | 7/2014 | Iannello et al. | |
| D710,250 | S | 8/2014 | Iannello et al. | |
| 8,950,640 | B2 | 2/2015 | Lannello et al. | |
| 9,386,807 | B2 | 7/2016 | Dalton | |
| D799,372 | S | 10/2017 | Paik et al. | |
| D839,716 | S | 2/2019 | Gertsma | |
| D854,815 | S | 7/2019 | Jensen | |
| D859,130 | S | 9/2019 | Spater | |
| D888,612 | S | 6/2020 | Spater | |
| D913,843 | S * | 3/2021 | Noble | D11/208 |
| 2006/0289575 | A1 | 12/2006 | Chou | |
| 2019/0137033 | A1 | 5/2019 | Chen | |
| 2019/0343241 | A1 | 11/2019 | Lovato | |
| 2020/0154864 | A1 | 5/2020 | Noble | |

OTHER PUBLICATIONS

Sidewinder Straps LG, no date available, [online],[site visited Jul. 20, 2020], Retrieved from url:https://www.511tactical.com/sidewinder-straps-ig-2pk.html (Year: 2020).

Sidewinder Straps SM, no date available, [online],[site visited Jul. 20, 2020], Retrieved from url:https://www.511tactical.com/sidewinder-straps-ig-2pk.html (Year: 2020).

Youtube 511 Tactical Sidewinder Straps and EDC Tools—2019 SHOT Show, GearSight, Jan. 26, 2019. [online],[site visited Jul. 20, 2020], Retrieved from url: https://www.youtube.com/watch?v=rMQPN0R2omc (Year: 2019).

* cited by examiner

AUXILIARY STRAP ASSEMBLY

CROSS-REFERENCE TO RELATED APPLICATIONS

This application is a continuation of U.S. patent application Ser. No. 16/688,917 entitled "AUXILIARY STRAP ASSEMBLY" and filed on Nov. 19, 2019, now U.S. Pat. No. 11,191,345, which claims the benefit under 35 U.S.C. § 119(e) of U.S. Patent Application No. 62/769,885, entitled "AUXILIARY STRAP ASSEMBLY" and filed on Nov. 20, 2018, each of which is hereby incorporated by reference in its entirety.

BACKGROUND

Field

The present disclosure relates to an auxiliary strap assembly for connection to an underlying load bearing platform, such as a backpack, bag or vest.

Description of the Related Art

Straps are often used for mounting objects to an underlying load bearing platform. However, because the straps are typically flexible, they fail to provide structure to the object(s) being secured with the straps. Moreover, depending on the type of underlying load bearing platform, tightening of the straps can tend to deform the shape of the underlying load bearing platform.

SUMMARY

In some implementations, an auxiliary strap assembly provides a simple, adjustable strap device for mounting objects to an underlying load bearing platform. In some implementations, the strap assembly includes an elongate anchor body that provides support to the object(s) being secured and/or to the underlying load bearing platform. The systems, methods and devices described herein have innovative aspects, no single one of which is indispensable or solely responsible for their desirable attributes. Without limiting the scope of the claims, some of the advantageous features will now be summarized.

In some implementations, an auxiliary strap assembly for mounting on an associated load bearing platform having a mounting grid arrangement includes an anchor body comprising at least one anchoring location. Each of the anchoring locations is configured to engage the mounting grid arrangement. A strap is attached to the anchor body at a first end. A second end and/or an intermediate portion of the strap is selectively attached or connected to the anchor body. The second end and/or the intermediate portion of the strap is adjustable relative to the anchor body.

In some implementations, the second end and/or the intermediate portion is infinitely adjustable or substantially infinitely adjustable within an available range of adjustment.

In some implementations, a cam lock arrangement receives the second end and/or the intermediate portion of the strap.

In some implementations, the cam lock arrangement comprises a body portion that defines a slot configured to receive the strap.

In some implementations, the slot is canted at an oblique angle relative to a longitudinal axis of the anchor body.

In some implementations, the slot has dimensions that are slightly larger than the cross-sectional dimensions of the strap, but close to the width of the strap so that the strap is held in alignment with the slot.

In some implementations, the cam lock arrangement comprises a lock body that is pivotally coupled to the body portion and is movable between a lock position, in which movement of the strap through the slot is inhibited or prevented, and a release position, in which movement of the strap through the slot is permitted.

In some implementations, the lock body comprises a lock surface that contacts a portion of the strap located within or adjacent the slot, and wherein the lock surface comprises a plurality of teeth configured to engage the strap.

In some implementations, the lock body comprises a release tab configured to allow a user to move the lock body to the release position with his or her finger.

In some implementations, the lock body includes a protrusion that contacts a cooperating surface on the body portion to limit rotational movement of the lock body.

In some implementations, each anchoring location includes a pair of slots located on opposing sides of the anchor body, wherein each slot includes an access opening configured to permit a webbing row or portion, or equivalent structure, to be introduced into the slot.

In some implementations, the anchor body is curved about its longitudinal axis.

In some implementations, the anchor body comprises strengthening protrusions or ribs that extend in a lengthwise direction of the anchor body or at least have a component extending in the lengthwise direction.

In some implementations, an auxiliary strap assembly for mounting on an associated load bearing platform having a mounting grid arrangement, includes an anchor body and a strap attached to the anchor body at a first end. A second end and/or an intermediate portion of the strap is selectively attached or connected to the anchor body. The second end and/or the intermediate portion of the strap is adjustable relative to the anchor body. The anchor body includes a pair of anchoring locations spaced apart from one another in a lengthwise direction of the anchor body a sufficient distance such that there are unused webbing rows or the equivalent located between the webbing rows engaged by the anchoring locations.

In some implementations, the anchor body has a sufficient length to create a mounting platform for the object(s) secured to an associated underlying load bearing platform using the strap assembly.

In some implementations, the anchor body has a length of about 80-250 mm, about 120-200 mm, about 150-175 mm or about 165 mm (e.g., 164.5 mm).

In some implementations, the second end and/or the intermediate portion is infinitely adjustable or substantially infinitely adjustable within an available range of adjustment.

In some implementations, the strap assembly comprises a cam lock arrangement receives the second end and/or the intermediate portion of the strap.

In some implementations, the cam lock arrangement comprises a body portion that defines a slot configured to receive the strap.

In some implementations, the slot is canted at an oblique angle relative to a longitudinal axis of the anchor body.

In some implementations, the slot has dimensions that are slightly larger than the cross-sectional dimensions of the strap, but close to the width of the strap so that the strap is held in alignment with the slot.

In some implementations, the cam lock arrangement comprises a lock body that is pivotally coupled to the body portion and is movable between a lock position, in which movement of the strap through the slot is inhibited or prevented, and a release position, in which movement of the strap through the slot is permitted.

In some implementations, the lock body comprises a lock surface that contacts a portion of the strap located within or adjacent the slot, and wherein the lock surface comprises a plurality of teeth configured to engage the strap.

In some implementations, the lock body comprises a release tab configured to allow a user to move the lock body to the release position with his or her finger.

In some implementations, the lock body includes a protrusion that contacts a cooperating surface on the body portion to limit rotational movement of the lock body.

In some implementations, each anchoring location includes a pair of slots located on opposing sides of the anchor body, wherein each slot includes an access opening configured to permit a webbing row or portion, or equivalent structure, to be introduced into the slot.

In some implementations, the anchor body is curved about its longitudinal axis.

In some implementations, the anchor body comprises strengthening protrusions or ribs that extend in a lengthwise direction of the anchor body or at least have a component extending in the lengthwise direction.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1A:
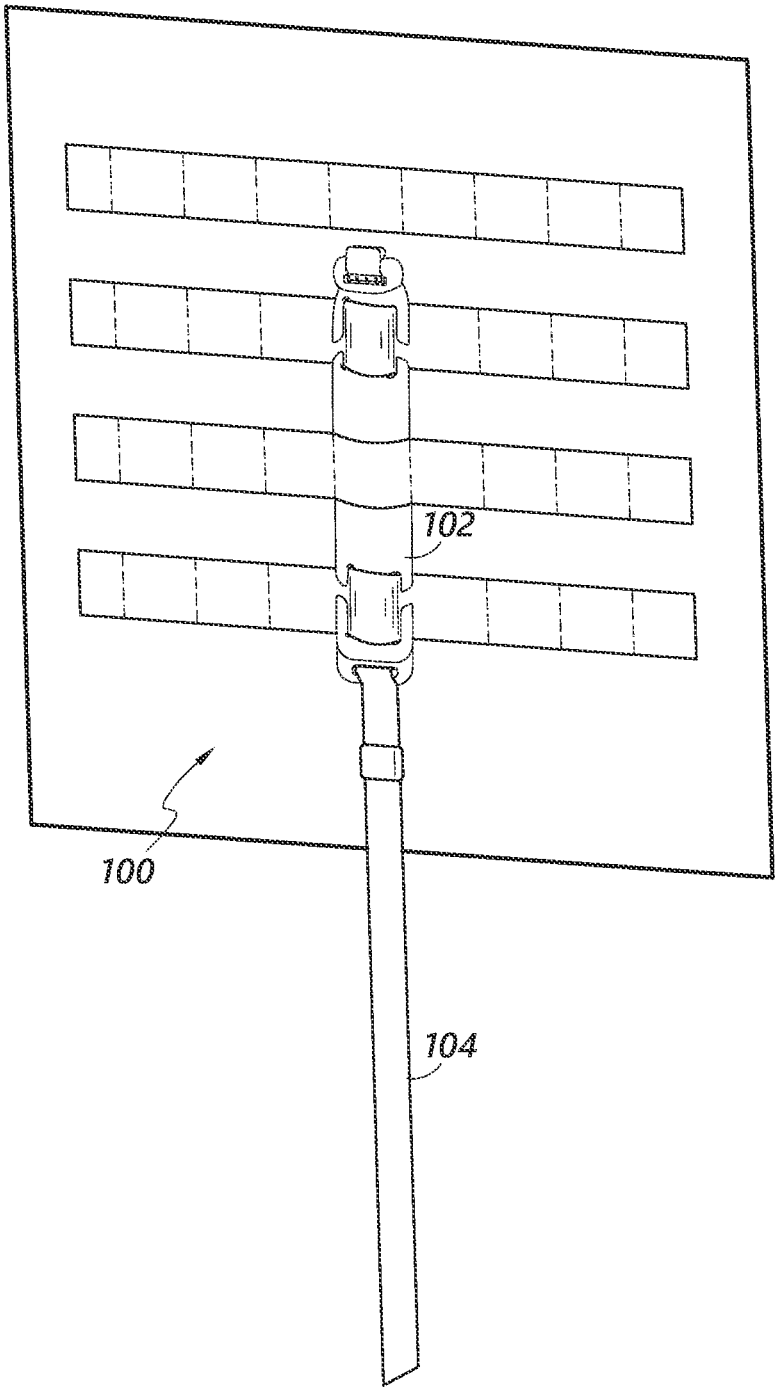
FIGS. 1*a* and 1*b* are perspective views of an auxiliary strap assembly assembled to an underlying load bearing platform having ladder webbing. The strap assembly includes an anchor body attached to the ladder webbing and a strap, shown in loose and attached configurations.
Figure 1B:
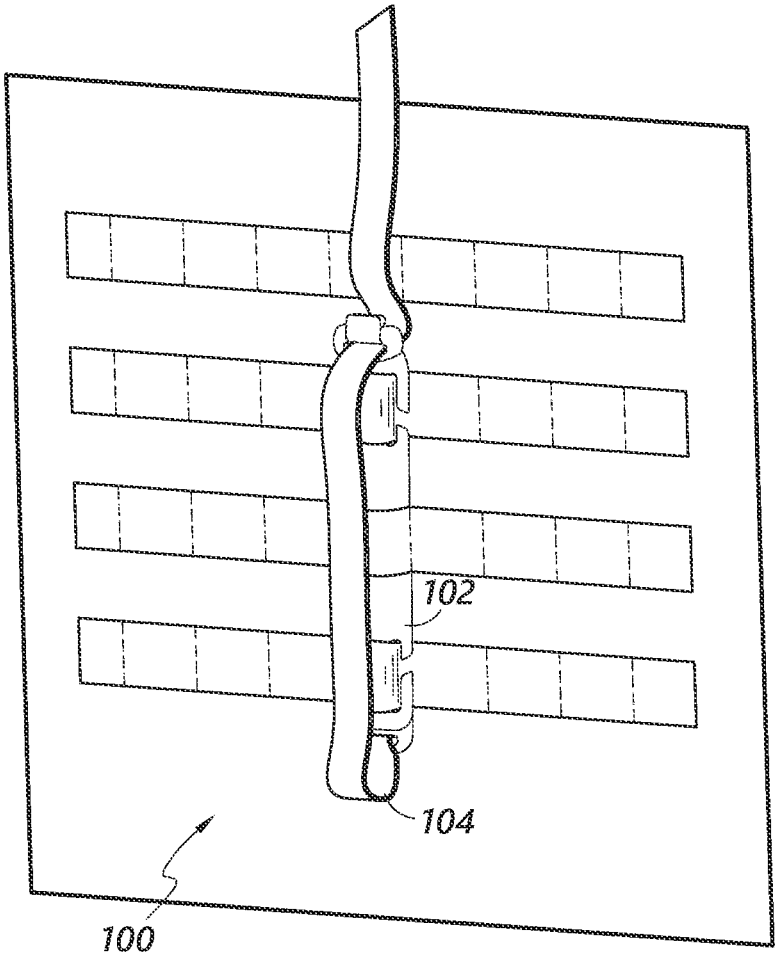
Figure 2A:
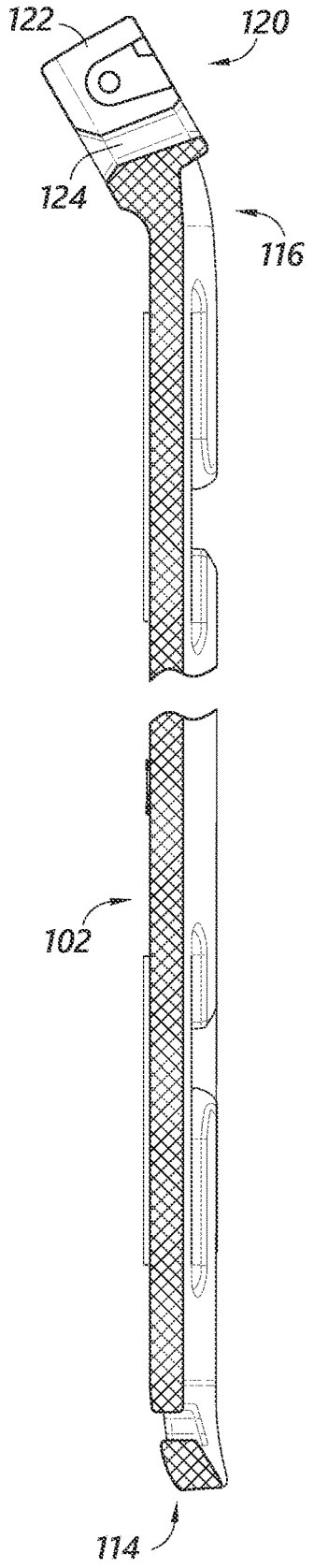
FIGS. 2*a*-2*f* are several views of the anchor body of the strap assembly of FIG. 1.
Figure 2B:
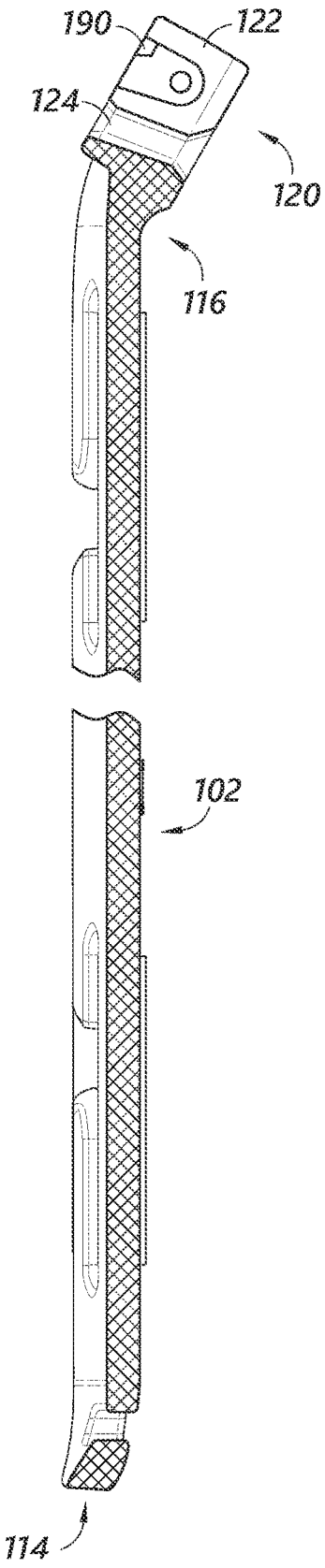
Figure 2C:
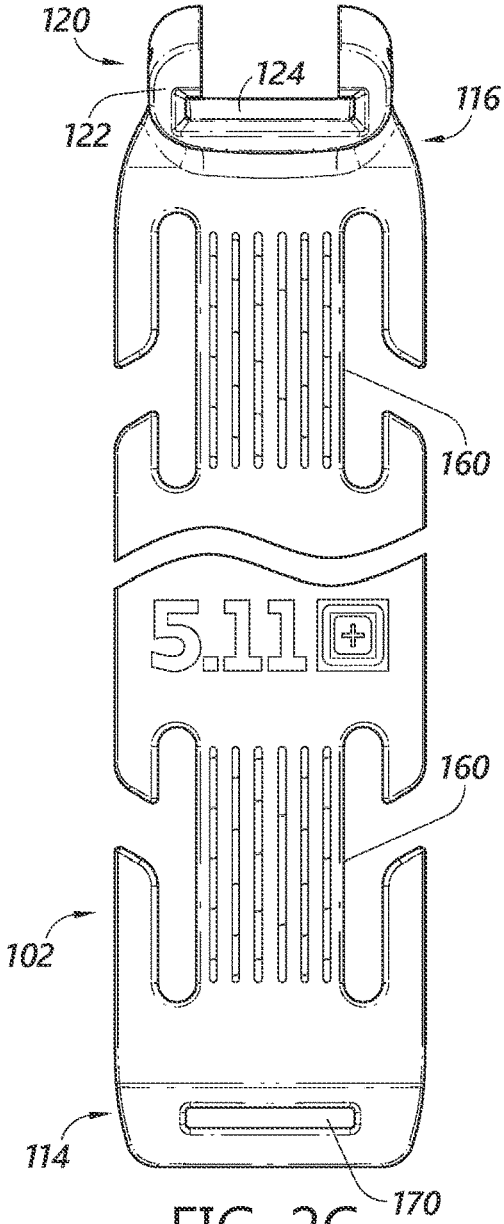
Figure 2D:
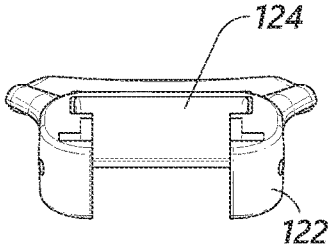
Figure 2E:
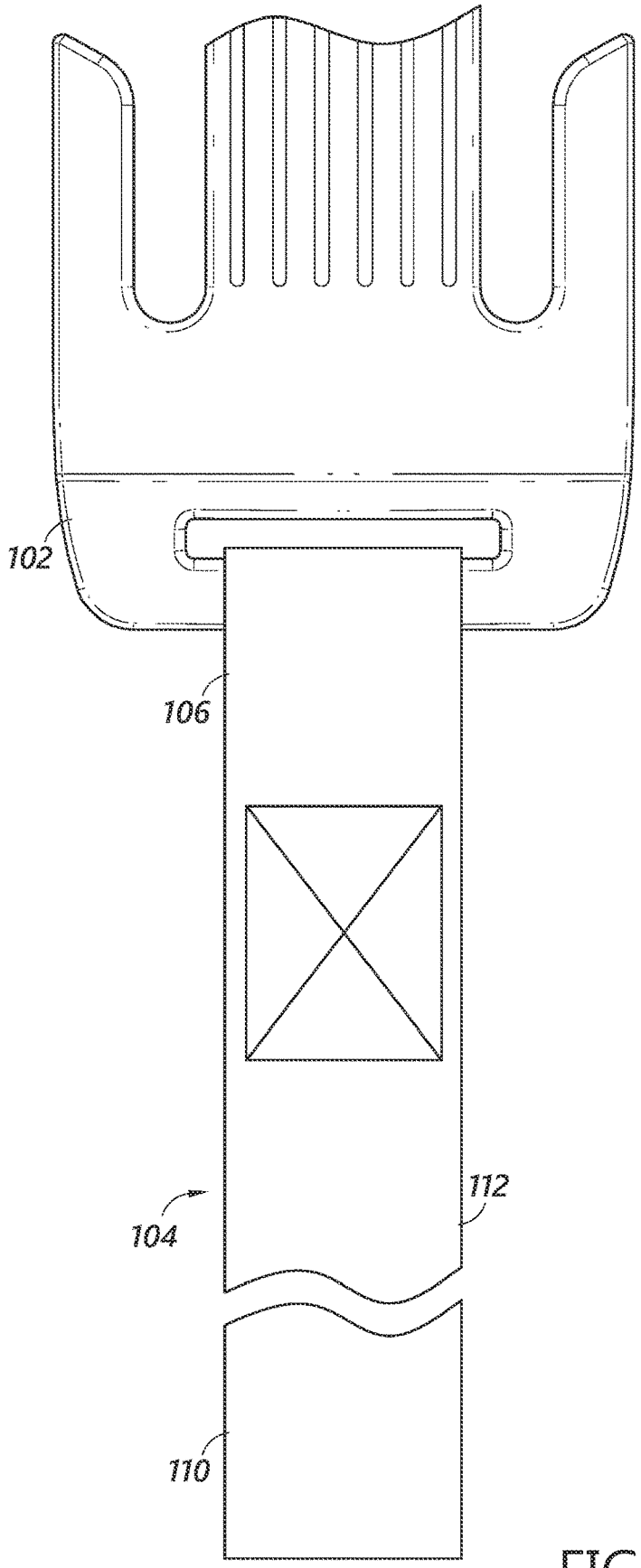
Figure 2F:
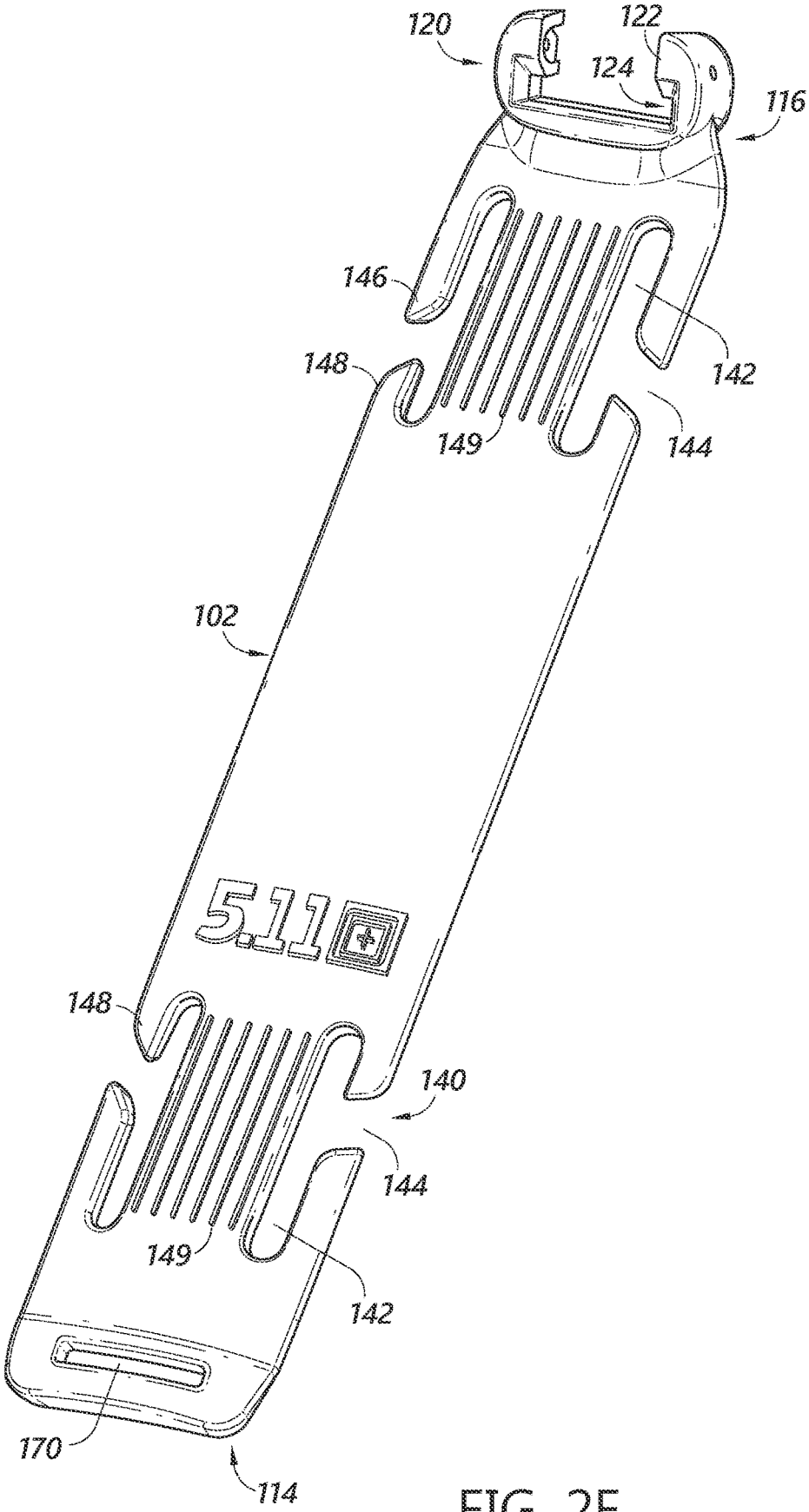
Figure 3A:
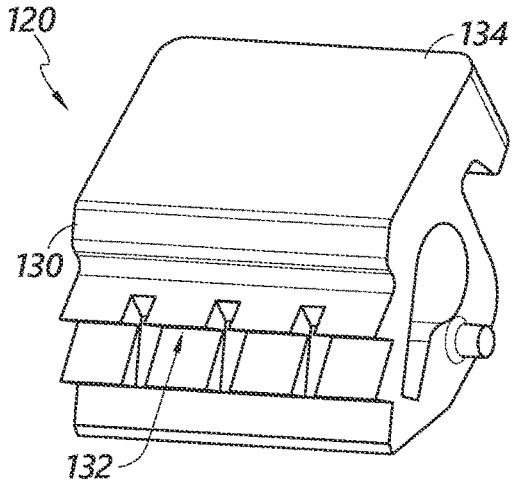
FIGS. 3*a*-3*e* are several views of a lock body of a cam lock arrangement of the strap assembly of FIG. 1.
Figure 3B:
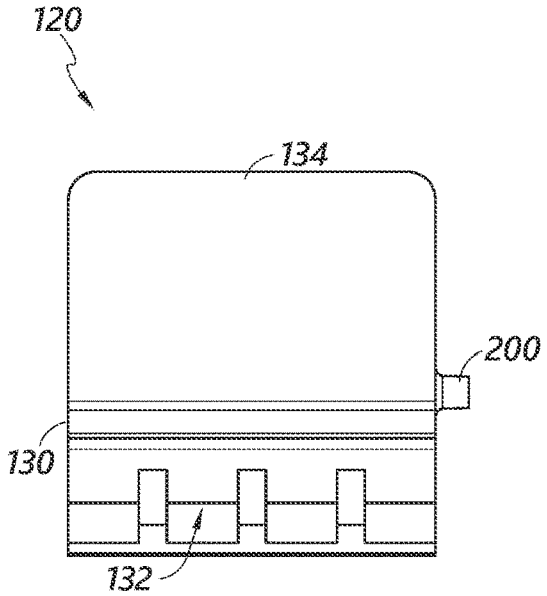
Figure 3C:
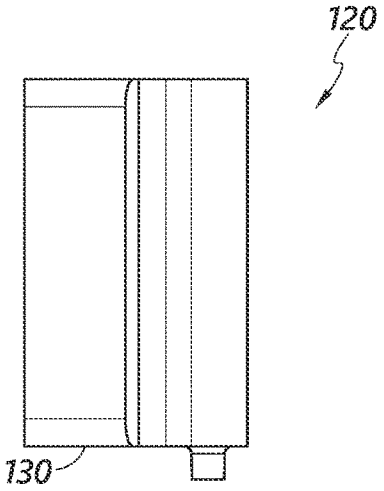
Figure 3D:
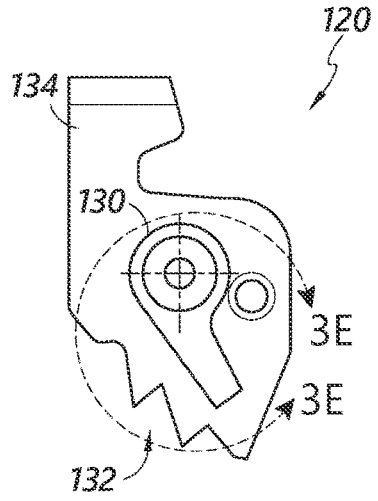
Figure 3E:
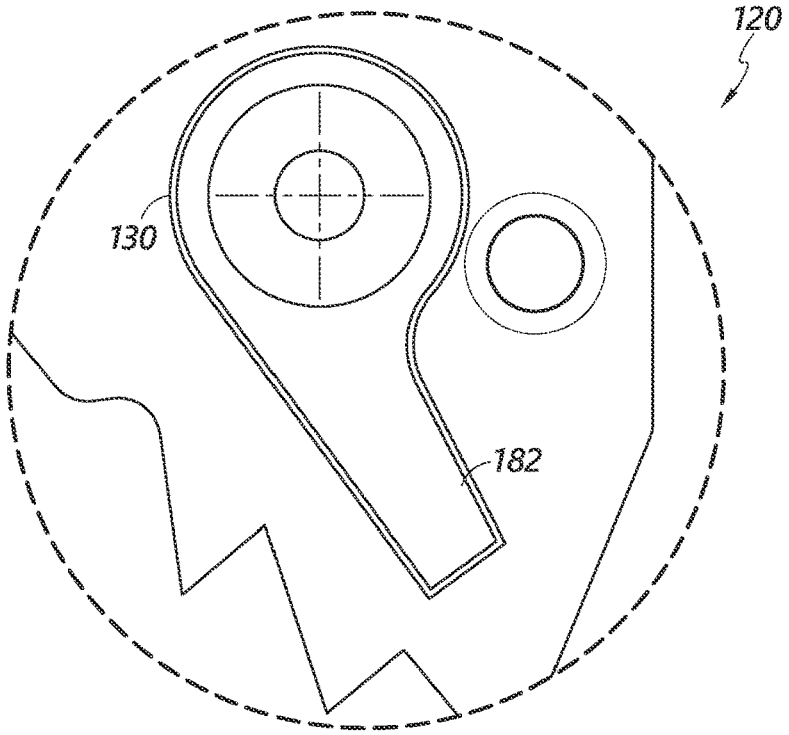

Embodiments of systems, components and methods of assembly and manufacture will now be described with reference to the accompanying figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described. Dimensions included in the drawings are by way of example only and are not intended to be limiting unless recited in the claims.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1*a*-7*b* illustrate an auxiliary or accessory strap assembly 100, or portions thereof, that is adapted for connection to an associated underlying load bearing platform, such as a bag (e.g., backpack, duffel bag) or a tactical vest, for example and without limitation. In some implementations, the strap assembly 100 is adapted for connection to ladder webbing, such as Pouch Attachment Ladder System (PALS) or HEXGRID® mounting system sold by 5.11 Tactical. The strap assembly 100 is configured to provide for attachment of objects to the associated load bearing platform. In some implementations, multiple strap assemblies 100 can be utilized together (e.g., arranged side-by-side) to secure one or more objects to the associated load bearing platform.

In the illustrated arrangement, the strap assembly 100 includes a body portion, which can be in the form of an anchor body 102. A strap 104 is attached to the anchor body 102 at a first end 106. A second end 110 and/or an intermediate portion 112 of the strap 104 can be selectively attached or connected to the anchor body 102. Preferably, the second end 110 and/or an intermediate portion 112 of the strap 104 is adjustable relative to the anchor body 102 when attached thereto. In the illustrated arrangement, the first end 106 of the strap 104 is permanently connected to a first end 114 of the anchor body 102 and the second end 110 and/or the intermediate portion 112 is connectable to a second end 116 of the anchor body 102. Preferably, the second end 110 and/or intermediate portion 112 is infinitely adjustable or substantially infinitely adjustable within an available range of adjustment.

In the illustrated arrangement, the second end 110 and/or the intermediate portion 112 of the strap 104 is selectively connectable to the anchor body 102 by a cam lock arrangement 120. The cam lock arrangement 120 includes a body portion 122 that defines a slot 124. The slot 124 is configured to receive the strap 104. Preferably, the slot 124 has dimensions that are slightly larger than the cross-sectional dimensions of the strap 104. In particular, preferably at least the width of the slot 124 is close to the width of the strap 104 so that the strap 104 is held in alignment with the slot 124. It has been discovered by the present inventors that a tight fit in at least a width direction of the strap 104 within the slot 124 provides secure locking of the strap 104 within the cam lock arrangement 120. In some implementations, the slot 124 has a width of about 14-20 mm, about 15-18 mm, or about 16.5 mm. The slot 124 and strap 104 can be sized relative to one another such that a total gap between the strap 104 and the slot 124 in a width direction is about 3-5 mm or about 4 mm (e.g., 3.8 mm). The strap 104 can have a width of about 10-16 mm, about 11-14 mm or about 13 mm (e.g., 12.7 mm). The width of the slot 124 and the strap 104 can have relative proportions in accordance with any of the aforementioned widths.

In the illustrated arrangement, the body portion 122 of the cam lock arrangement 120 is unitary with the anchor body 102. However, in other arrangements the body portion 122 could be separate from the anchor body 102 and coupled thereto. In the illustrated arrangement, the body portion 122 is located on at least portions of four sides of the slot 124. In particular, the body portion 122 is located along entireties of a bottom and both sides of the slot 124. In addition, the body portion 122 is located along opposing side portions of the top of the slot 124. For the sake of the present description, the bottom of the slot 124 is located relatively closer to a center of the anchor body 102 and a top of the slot 124 is located relatively further from the center of the anchor body 102. In the illustrated arrangement, the body portion 122 and the slot 124 of the cam lock arrangement 120 are canted at an oblique (non-perpendicular) angle relative to a longitudinal axis of the anchor body 102. Such an arrangement assists in threading the strap 104 through the cam lock arrangement 120 when the strap assembly 100 is in place on an associated load bearing platform.

The cam lock arrangement 120 also includes a lock body 130 (FIGS. 3*a*-3*e*) that is movably coupled to the body portion 122. In the illustrated arrangement, the lock body 130 is pivotally coupled to the body portion 122, such as by a pivot shaft or pivot pin 136 (FIGS. 5*a*-5*b*) that extends through a cavity in the lock body 130. The lock body 130 is movable between a lock position in which movement of the strap 104 through the slot 124 is inhibited or preferably prevented (at least up to a maximum locking force of the cam lock arrangement 120) and a release position in which movement of the strap 104 through the slot 124 is permitted. The lock body 130 has a lock surface 132 that contacts a portion of the strap 104 located within or adjacent the slot 124. The illustrated lock surface 132 comprises a raised geometry or roughened surface, which in one implementation can be provided by a plurality of teeth, configured to engage the strap 104. Preferably, the spacing of the teeth is selected to correspond to surface features (e.g., weave pattern/spacing) of the strap 104. The lock body 130 also has a release tab 134 configured to allow a user to move the lock body 130 to the release position with his or her finger.

The anchor body 102 preferably includes one or more anchoring locations 140, each of which are configured to secure the anchor body 102 or a portion thereof to the ladder webbing or equivalent. Each anchoring location 140 includes at least one slot 142. In the illustrated arrangement, each anchoring located 140 includes a slot 142 located on opposing sides of the anchor body 102. The slots 142 (and resultant or corresponding structure) are mirror images of each other. Each slot 142 includes an access opening 144 configured to permit a webbing row or portion, or equivalent structure, to be introduced into the slot 142. In the illustrated arrangement, the access opening 144 is located in an intermediate portion of the slot 142 such that the slot 142 extends in each direction from the access opening 144. Such an arrangement inhibits the webbing row or portion, or equivalent structure, from being unintentionally dislodged from the slot 142. The anchor body 102 includes at least one arm, and preferably a first arm 146 and a second arm 148 extending along an outside of the slot 142 and one opposing sides of the access opening 144. In the illustrated arrangement, the first arm 146 is larger than the second arm 148. The first arms 146 and/or the second arms 148 can be positioned on an opposite side of the ladder webbing (or other mounting structure) from a neck portion 149 of the anchor body 102 located between the slots 142 to inhibit undesired movement of the anchor body 102 relative to the associated load bearing platform.

In the illustrated arrangement, the anchor body 102 includes a pair of anchoring locations 140. Preferably, the anchoring locations 140 are spaced apart a sufficient distance such that there are unused webbing rows (or the equivalent) located between the webbing rows engaged by the anchoring locations 140. In other words, preferably the anchor body 102 has a sufficient length to create a mounting platform for the object(s) secured to the underlying load bearing platform using the strap assembly 100. In some implementations, the anchor body 102 has a length of about 80-250 mm, about 120-200 mm, about 150-175 mm or about 165 mm (e.g., 164.5 mm).

A width of the anchor body 102 can be selected for compatibility with the desired mounting arrangement(s) or system(s). In some implementations, the maximum width of the anchor body 102 is about 25-35 mm, about 28-32 mm or about 30 mm (e.g., 30.6 mm). A width of the neck portion 149 can be about 12-16 mm, about 14-15 mm or about 14.5 mm. A width of each of the slots 142 can be about 3-5 mm or about 4 mm (e.g., 3.8 mm).

The anchor body 102 can be constructed from any suitable material or combination of materials by any suitable process. In some implementations, the anchor body 102 is constructed from an injection-molded plastic. Similarly, the strap 104 can be constructed from any suitable material or combination of materials by any suitable process. In some implementations, the strap 104 is a woven nylon or similar material.

The anchor body 102 can include features configured to enhance its rigidity. For example, the anchor body 102 can be curved about its longitudinal axis—that is, curved in a side-to-side direction such that the front surface and/or the rear surface of the anchor body 102 is curved. Such an arrangement provides greater resistance to bending than a flat body of the same size and material. The anchor body 102 in addition or in the alternative can include strengthening protrusions or ribs 160 that extend in a lengthwise direction of the anchor body 102 or at least have a component extending in the lengthwise direction. In the illustrated arrangement, a plurality of the ribs 160 are located in the neck portion 149. However, preferably, a plurality of ribs are also provided on the rear surface and extend in a lengthwise direction of the anchor body 102.

The first end 106 of the strap 104 can be coupled to the anchor body 102 by any suitable arrangement. In some implementations, the first end 106 of the strap 104 is permanently connected to the anchor body 102. For example, the first end 114 of the anchor body 102 defines a fully enclosed slot 170 that extends in a widthwise direction of the anchor body 102. The first end 106 of the strap 104 is passed through the slot 170 and attached to itself by a suitable fastening mechanism or arrangement, such as by a sewn joint.

Figure 4A:
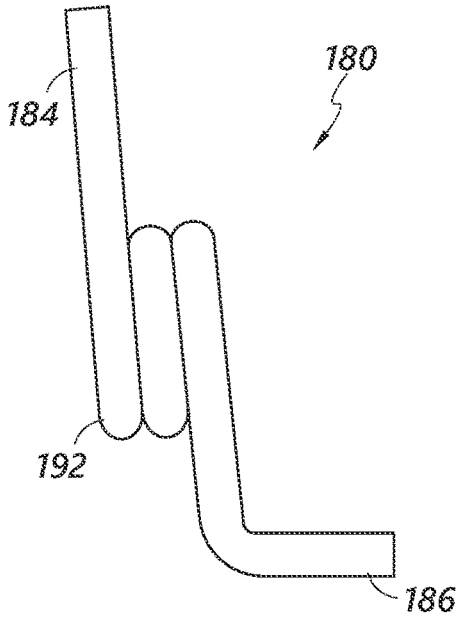
FIGS. 4*a*-4*c* are several views of a biasing element in the form of a torsion spring for biasing the lock body toward a lock position.
Figure 4B:
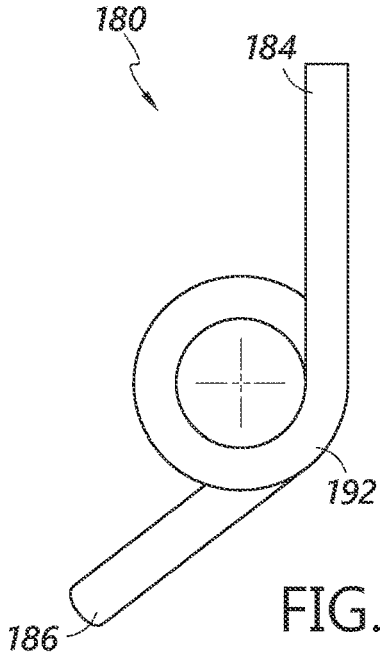
Figure 4C:
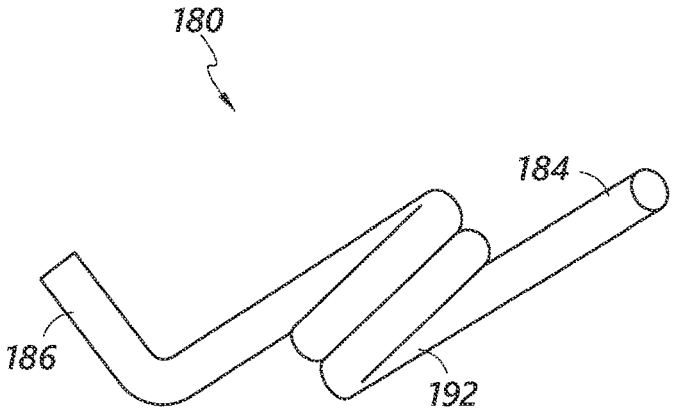
Figure 5A:
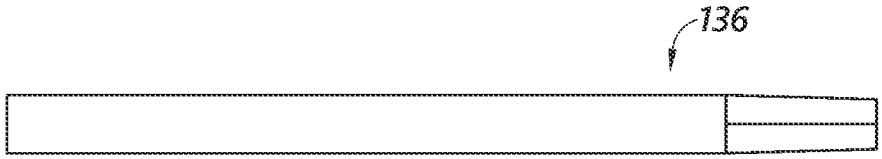
FIGS. 5*a* and 5*b* are two views of a pivot pin upon which the lock body and biasing element are carried.
Figure 5B:
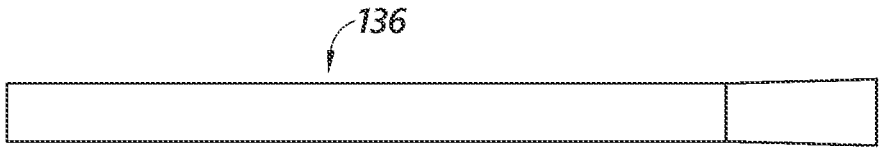
Figure 6A:
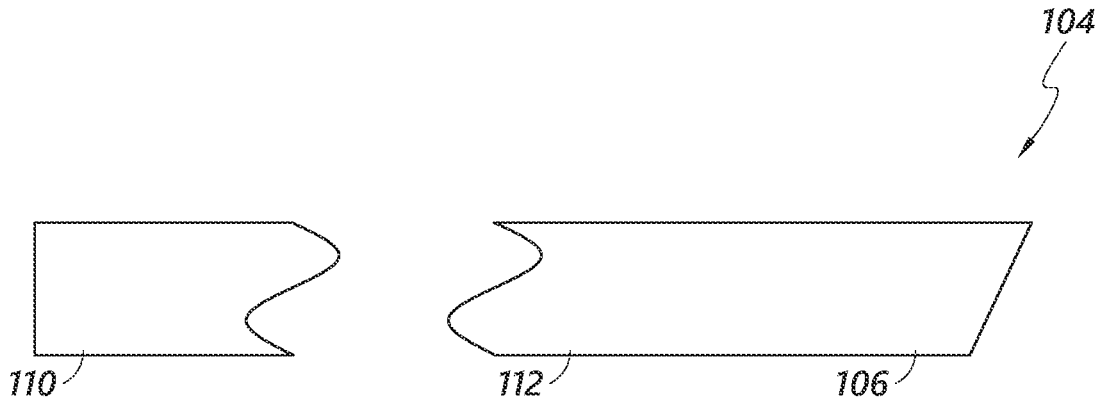
FIGS. 6*a* and 6*b* are two views of a strap of the strap assembly of FIG. 1.
Figure 6B:
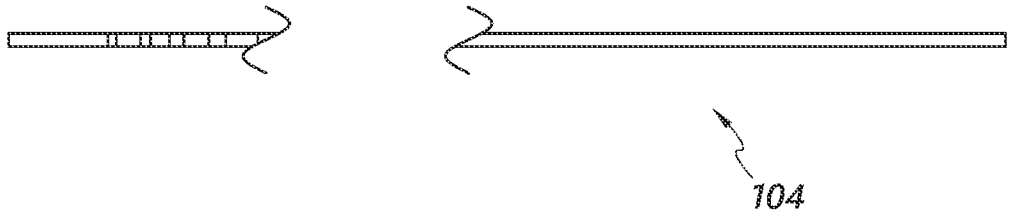
Figure 7A:
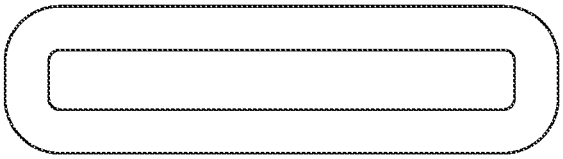
FIGS. 7*a* and 7*b* are two views of a strap loop that is used to secure a loose portion of the strap of FIGS. 6*a* and 6*b*.
Figure 7B:
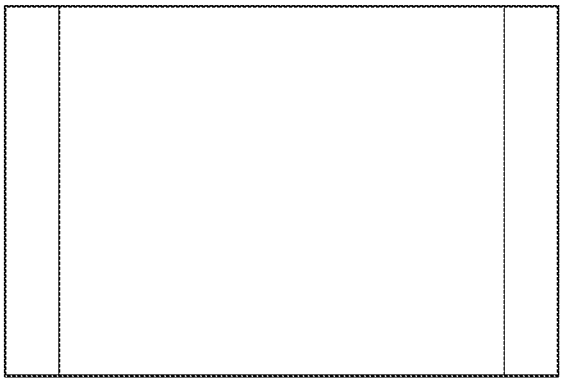
Figure 8A:
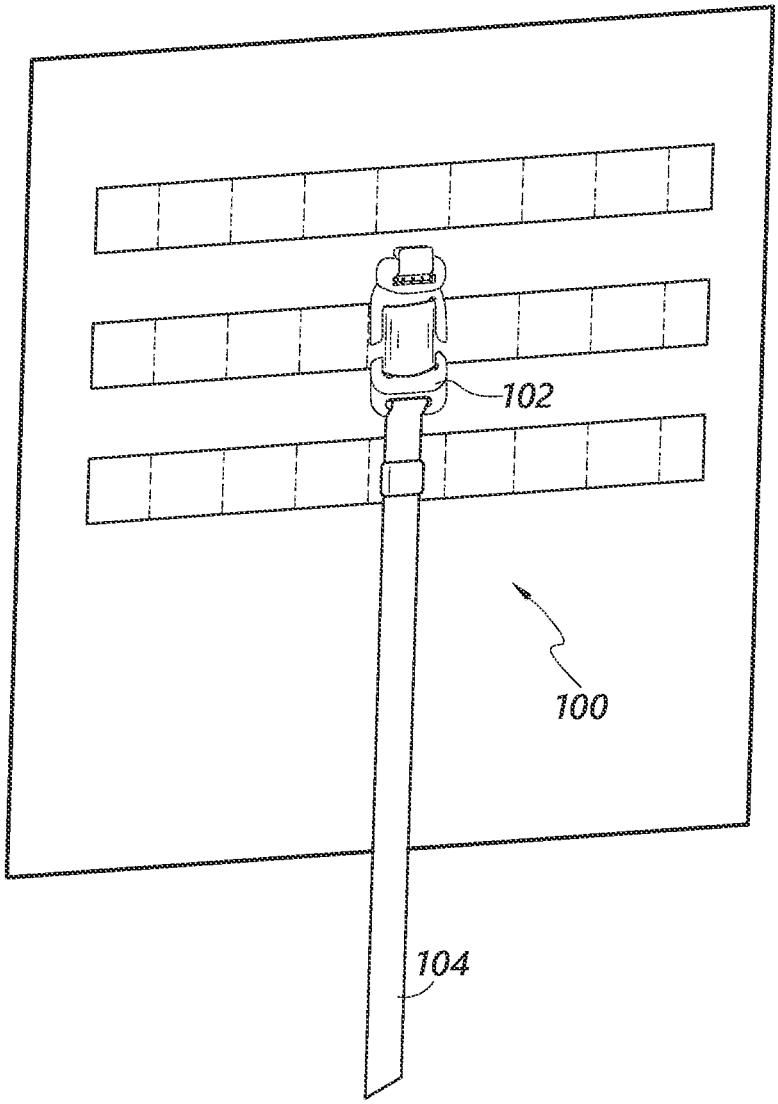
FIGS. 8*a* and 8*b* are two views of an alternative strap assembly assembled to an underlying load bearing platform.
Figure 8B:
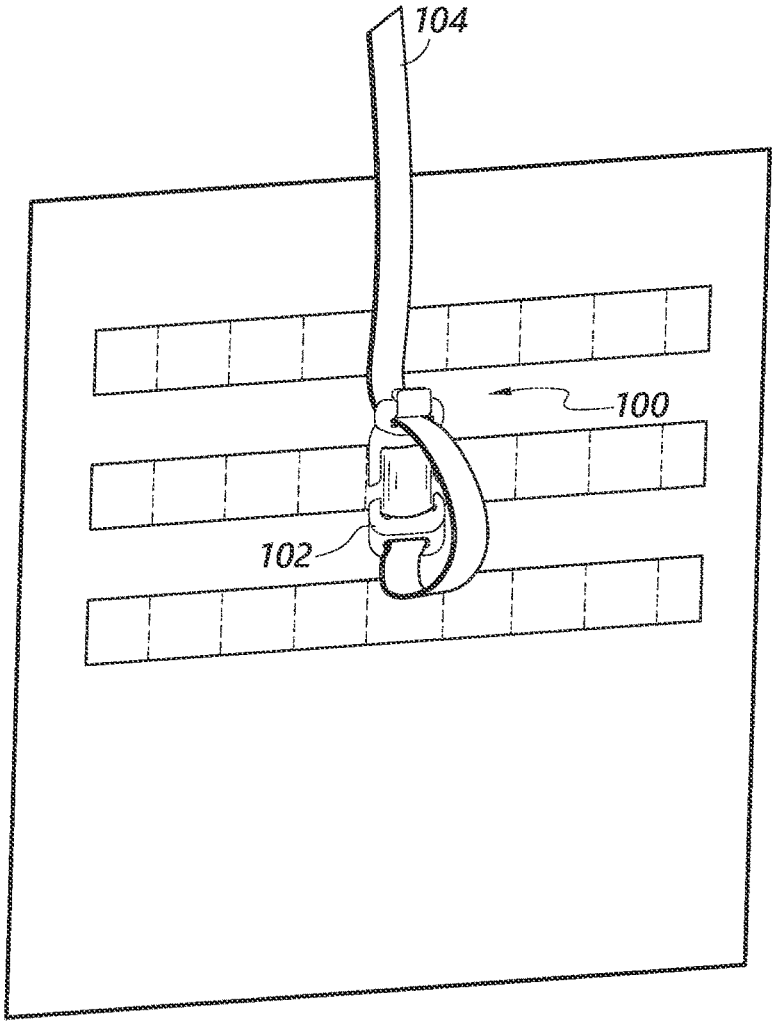
Figure 9A:
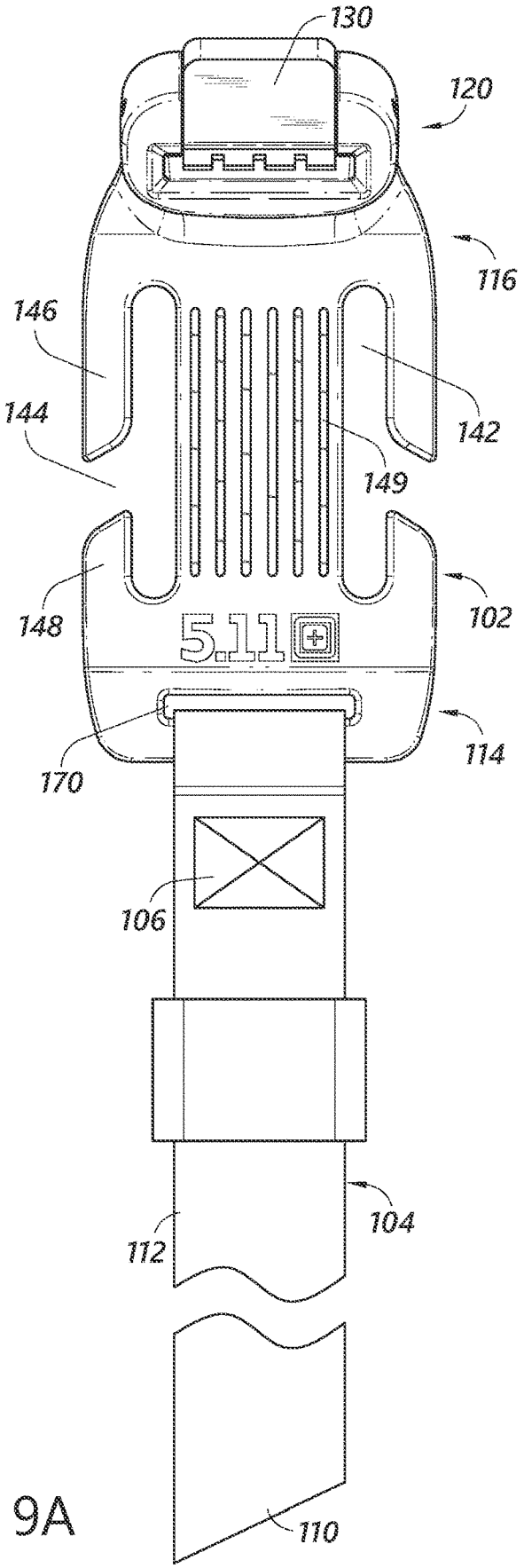
FIGS. 9*a*-9*d* are several views of the strap assembly of FIGS. 8*a* and 8*b*.
Figure 9B:
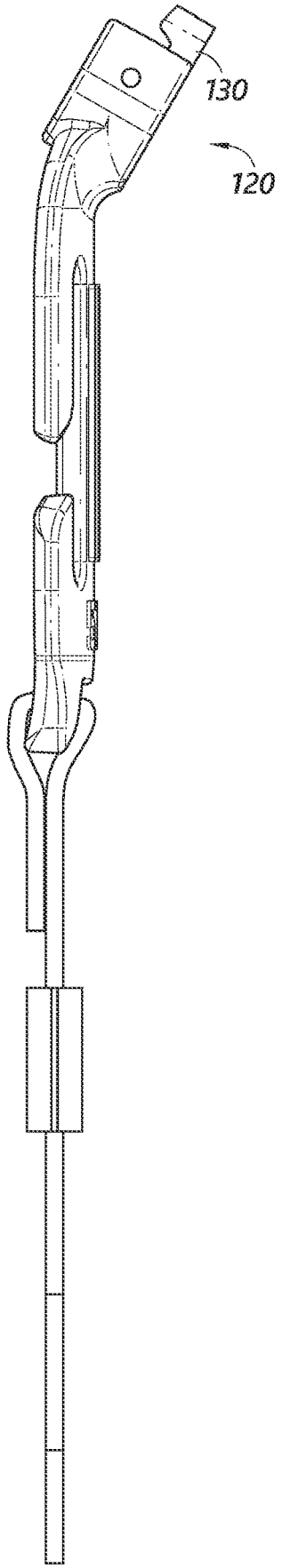
Figure 9C:
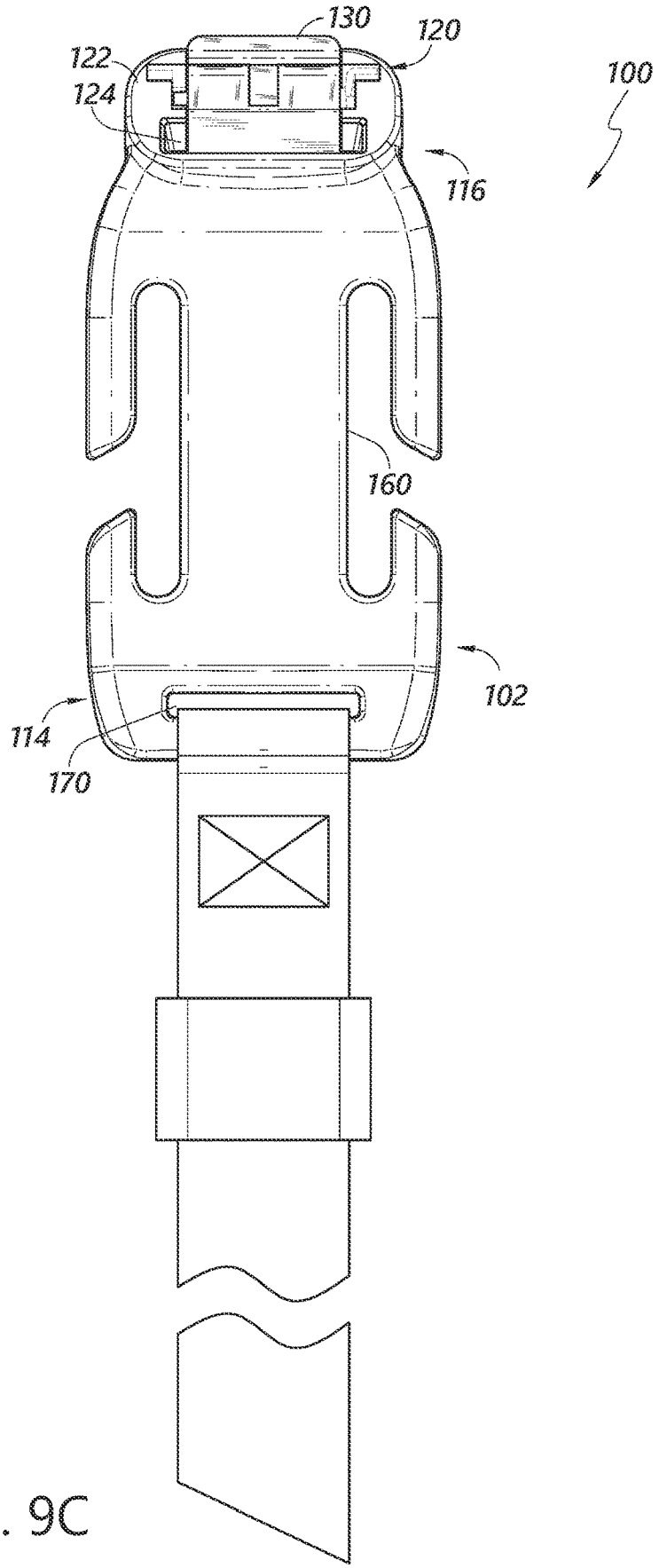
Figure 9D:
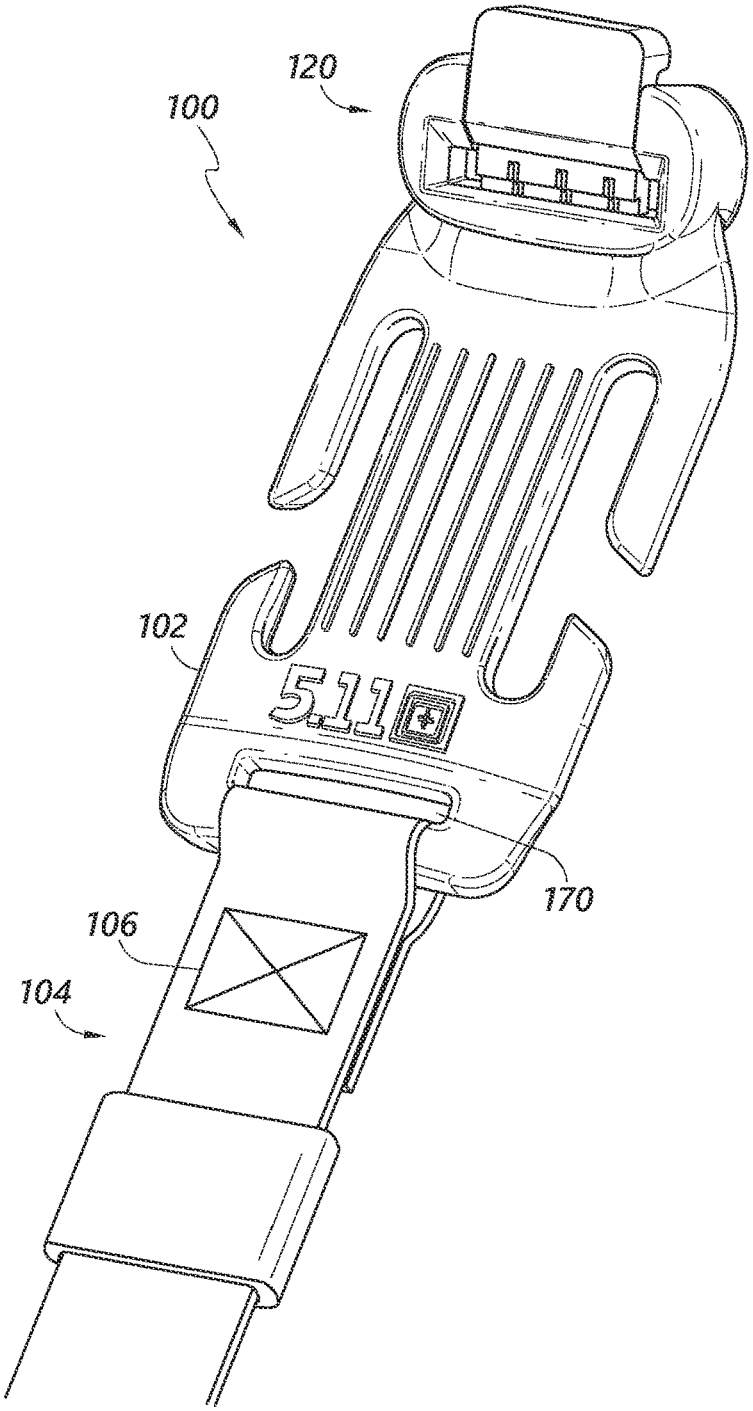
Figure 10A:
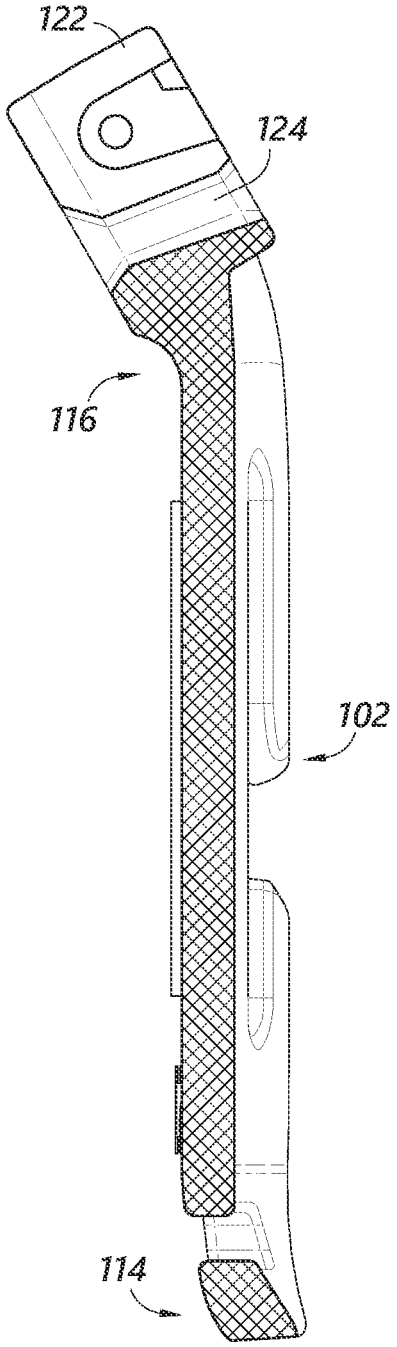
FIGS. 10*a*-10*e* are several views of an anchor body of the strap assembly of FIGS. 8*a*, 8*b* and 9*a*-9*d*.
Figure 10B:
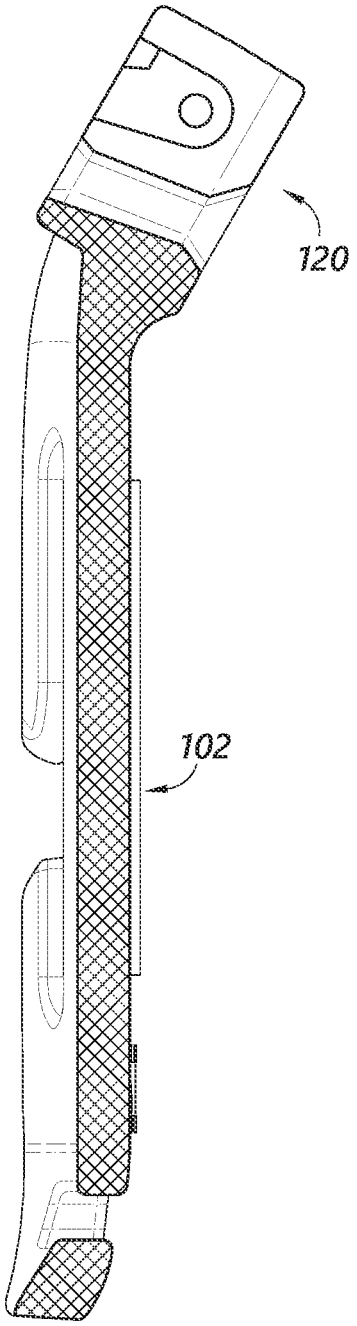
Figure 10C:
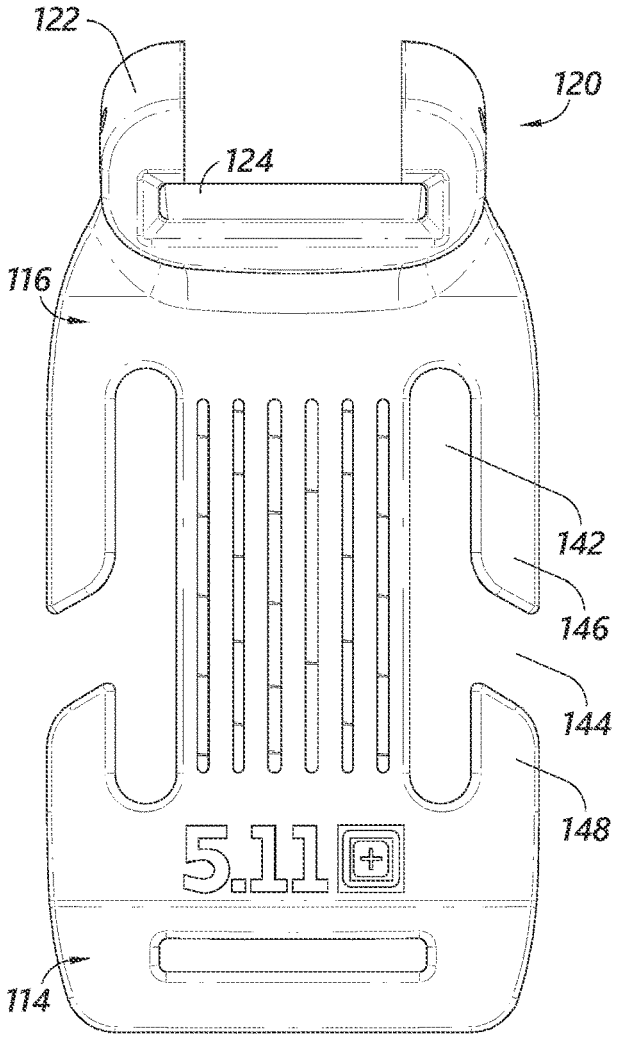
Figure 10D:
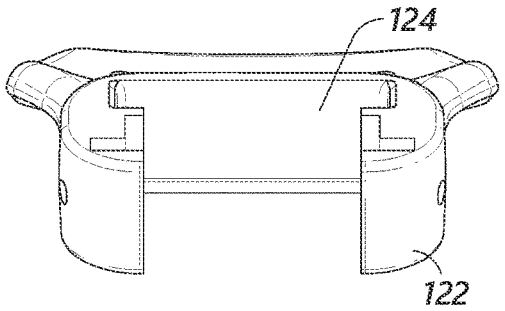
Figure 10E:
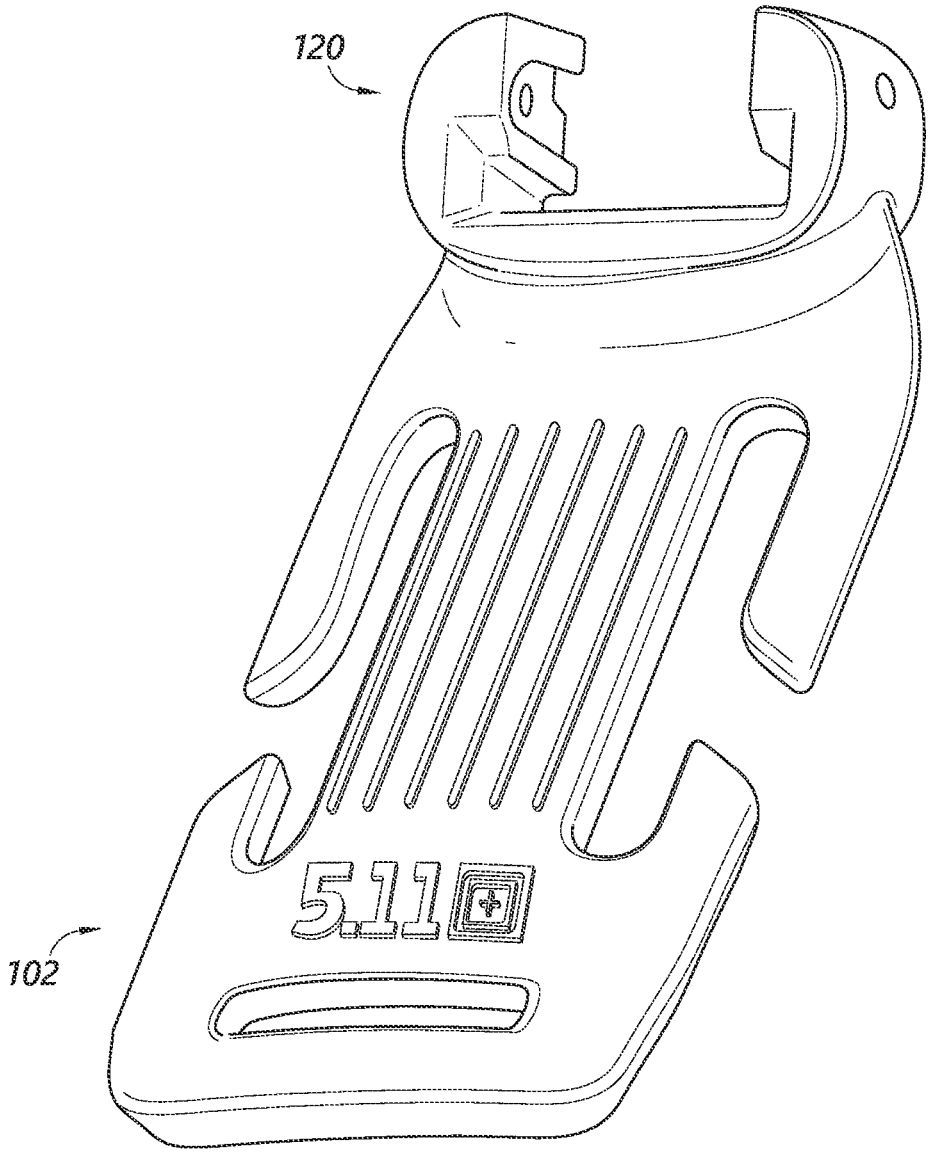

As described above, the lock body 130 of the cam lock arrangement 120 is pivotally coupled to the body portion 122. Preferably, the lock body 130 is biased toward the lock position by a biasing element or mechanism, such as a biasing spring 180 (FIGS. 4*a*-4*c*). The biasing spring 180 can be at least partially located within a cavity 182 of the lock body 130. The biasing spring 180 can have a first end 184 that acts on the lock body 130 and a second end 186 that acts on the body portion 122. The second end 186 can be received within a hole 190 of the body portion 122. The biasing spring 180 can be a torsion spring having a wound portion 192, which can surround the pivot pin 136.

The user can utilize the release tab 134 to move the lock body 130 against the biasing force of the biasing spring 180 toward or to the release position. The cam lock arrangement 120 can include a stop arrangement that limits movement of the lock body 130 relative to the body portion 122 and/or defines the release position. In some implementations, the lock body 130 includes a protrusion 200 that contacts a cooperating surface on the body portion 122 to limit rotational movement of the lock body 130.

FIGS. 8*a*-10*e* illustrate another version of the strap assembly 100, in which the anchor body 102 includes a single anchoring location 140. The anchor body 102 can be substantially shorter than the previously-described anchor body 102. For example, the anchor body 102 having a single anchoring location 140 can have a length of about 50-70 mm or about 60 mm. In other respects, the strap assembly 100 can be the same as or substantially the same as described above.

Conclusion

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. An auxiliary strap assembly for mounting on an associated load bearing platform having a mounting grid arrangement, comprising:

an anchor body comprising;

at least one anchoring location, each configured to engage the mounting grid arrangement; and a lock surface;

a slot;

a lock body that is pivotally coupled to an adjacent portion of the anchor body;

a strap attached to the anchor body at a first end;

wherein the lock surface is configured to engage a second end or an intermediate portion of the strap to selectively couple the second end or the intermediate portion of the strap to the anchor body;

wherein the second end or the intermediate portion of the strap is adjustable relative to the anchor body;

wherein the slot is configured to receive the second end and/or the intermediate portion of the strap; and wherein the lock body is movable between a lock position, in which movement of the strap through the slot is inhibited or prevented, and a release position, in which movement of the strap through the slot is permitted.

2. The auxiliary strap assembly of claim 1, wherein the second end and/or the intermediate portion is infinitely adjustable or substantially infinitely adjustable within an available range of adjustment.

3. The auxiliary strap assembly of claim 1, wherein the lock surface comprises a plurality of teeth configured to engage the strap.

4. The auxiliary strap assembly of claim 1, wherein the slot is canted at an oblique angle relative to a longitudinal axis of the anchor body.

5. The auxiliary strap assembly of claim 1, wherein the slot has dimensions that are slightly larger than a cross-sectional dimensions of the strap, but close to a width of the strap so that the strap is held in alignment with the slot.

6. The auxiliary strap assembly of claim 1, wherein the lock surface is located on the lock body.

7. The auxiliary strap assembly of claim 1, wherein the lock body comprises a release tab configured to allow a user to move the lock body to the release position with his or her finger.

8. The auxiliary strap assembly of claim 1, wherein the lock body includes a protrusion that contacts a cooperating surface on the anchor body to limit rotational movement of the lock body.

9. The auxiliary strap assembly of claim 1, wherein each anchoring location includes a pair of slots located on opposing sides of the anchor body, wherein each slot includes an access opening configured to permit a webbing row or portion, or equivalent structure, to be introduced into the slot.

10. The auxiliary strap assembly of claim 1, wherein the anchor body is curved about its longitudinal axis.

11. The auxiliary strap assembly of claim 10, wherein the anchor body comprises strengthening protrusions or ribs that extend in a lengthwise direction of the anchor body or at least have a component extending in the lengthwise direction.

12. The auxiliary strap assembly of claim 1, wherein the lock surface at least partially defines the slot.

13. An auxiliary strap assembly for mounting on an associated load bearing platform having a mounting grid arrangement, comprising:

an anchor body comprising;

at least one anchoring location, each configured to engage the mounting grid arrangement; and a slot;

a movable lock body located adjacent the slot;

a strap attached to the anchor body at a first end;

wherein the slot is configured to receive a second end or an intermediate portion of the strap and the lock body is configured to engage the strap to adjustably couple the second end or the intermediate portion of the strap to the anchor body.

14. The auxiliary strap assembly of claim 13, wherein a lock surface of the lock body comprises a plurality of teeth configured to engage the strap.

15. The auxiliary strap assembly of claim 13, wherein the slot has dimensions that are slightly larger than a cross-sectional dimensions of the strap, but close to a width of the strap so that the strap is held in alignment with the slot.

16. The auxiliary strap assembly of claim 13, wherein the second end or the intermediate portion is infinitely adjustable or substantially infinitely adjustable within an available range of adjustment.

17. The auxiliary strap assembly of claim 13, wherein each anchoring location includes a pair of slots located on opposing sides of the anchor body, wherein each slot includes an access opening configured to permit a webbing row or portion, or equivalent structure, to be introduced into the slot.

18. The auxiliary strap assembly of claim 13, wherein the anchor body is curved about its longitudinal axis.

* * * * *